US009395680B2

(12) United States Patent
Kato

(10) Patent No.: US 9,395,680 B2
(45) **Date of Patent: *Jul. 19, 2016**

(54) DEVELOPER CARTRIDGE

(71) Applicant: Brother Kogyo Kabushiki Kaisha, Nagoya-shi, Aichi-ken (JP)

(72) Inventor: Shuichi Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/878,094

(22) Filed: Oct. 8, 2015

(65) Prior Publication Data

US 2016/0026150 A1 Jan. 28, 2016

Related U.S. Application Data

(63) Continuation of application No. 14/511,819, filed on Oct. 10, 2014, now Pat. No. 9,201,388, which is a continuation of application No. 13/069,678, filed on Mar. 23, 2011, now Pat. No. 8,862,013.

(30) Foreign Application Priority Data

Mar. 26, 2010 (JP) ..... 2010-072621

(51) Int. Cl.

| | |
|---|---|
| ***G03G 21/16*** | (2006.01) |
| ***G03G 15/08*** | (2006.01) |
| ***G03G 21/18*** | (2006.01) |

(52) U.S. Cl.

CPC ..... *G03G 21/1652* (2013.01); *G03G 15/0832* (2013.01); *G03G 15/0855* (2013.01); *G03G 15/0865* (2013.01); *G03G 21/1676* (2013.01); *G03G 21/1871* (2013.01)

(58) Field of Classification Search

None

See application file for complete search history.

(56) References Cited

U.S. PATENT DOCUMENTS

| | | | |
|---|---|---|---|
| 6,366,746 | B1 | 4/2002 | Sasago et al. |
| 6,386,899 | B1 | 5/2002 | Ushio et al. |

(Continued)

FOREIGN PATENT DOCUMENTS

| | | |
|---|---|---|
| CN | 2849777 Y | 12/2006 |
| JP | H5-45735 | 6/1993 |

(Continued)

OTHER PUBLICATIONS

Office Action issued to corresponding Chinese Patent Application No. 201110082128.3 o Jul. 31, 2012.

(Continued)

*Primary Examiner* — Clayton E LaBalle
*Assistant Examiner* — Jas Sanghera
(74) *Attorney, Agent, or Firm* — Banner & Witcoff, Ltd.

(57) ABSTRACT

In a developer cartridge, a base portion may be fixed to a surface of one side of a frame, and extend from one end thereof to another end thereof in a second direction orthogonal to the first direction. A first portion may extend from one end thereof to another end thereof in the first direction. The one end of the first portion is connected to the other end of the base portion. A second portion may extend from one end thereof to another end thereof in a direction opposite to the second direction. The one end of the second portion is connected to the other end of the first portion. An electrode for the cartridge is deformable such that a distance between the base portion and the second portion can be decreased.

9 Claims, 10 Drawing Sheets

(56) References Cited

U.S. PATENT DOCUMENTS

| | | | | |
|---|---|---|---|---|
| 6,832,057 | B2 | 12/2004 | Oguma et al. | |
| 7,369,792 | B2 | 5/2008 | Shiraki | |
| 7,386,253 | B2 | 6/2008 | Ishii et al. | |
| 7,412,188 | B2 | 8/2008 | Ishii et al. | |
| 7,450,882 | B2 | 11/2008 | Shiraki | |
| 7,522,859 | B2 | 4/2009 | Ishii et al. | |
| 7,565,092 | B2 | 7/2009 | Shiraki | |
| 7,761,023 | B2 | 7/2010 | Sato | |
| 7,796,915 | B2 | 9/2010 | Ishii et al. | |
| 7,844,197 | B2 | 11/2010 | Ishii et al. | |
| 7,873,296 | B2 | 1/2011 | Ishii et al. | |
| 7,957,669 | B2 | 6/2011 | Ishii et al. | |
| 8,050,593 | B2 | 11/2011 | Furuichi et al. | |
| 8,862,013 | B2 * | 10/2014 | Kato | G03G 15/0832 399/119 |
| 2002/0022400 | A1 | 2/2002 | Ushio et al. | |
| 2002/0025174 | A1 * | 2/2002 | Sakurai | G03G 21/1814 399/13 |
| 2003/0180061 | A1 | 9/2003 | Oguma et al. | |
| 2003/0185594 | A1 * | 10/2003 | Okabe | G03G 15/0896 399/222 |
| 2006/0029418 | A1 | 2/2006 | Ishii et al. | |
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0029423 | A1 | 2/2006 | Shiraki | |
| 2006/0159483 | A1 | 7/2006 | Yokoi | |
| 2007/0122175 | A1 | 5/2007 | Sato | |
| 2008/0170882 | A1 | 7/2008 | Ishii et al. | |
| 2008/0279583 | A1 | 11/2008 | Ishii et al. | |
| 2008/0292356 | A1 | 11/2008 | Furuichi et al. | |
| 2008/0310881 | A1 | 12/2008 | Sato | |
| 2009/0169235 | A1 | 7/2009 | Kamimura | |
| 2009/0169248 | A1 | 7/2009 | Ishii et al. | |
| 2009/0169256 | A1 | 7/2009 | Kamimura et al. | |
| 2011/0064461 | A1 | 3/2011 | Ishii et al. | |

FOREIGN PATENT DOCUMENTS

| | | | |
|---|---|---|---|
| JP | 2001293928 | A | 10/2001 |
| JP | 2002278413 | A | 9/2002 |
| JP | 2003280354 | A | 10/2003 |
| JP | 2005266545 | A | 9/2005 |
| JP | 2006058598 | A | 3/2006 |
| JP | 2007148286 | A | 6/2007 |
| JP | 2008-292769 | A | 12/2008 |
| JP | 2009-162908 | A | 7/2009 |

OTHER PUBLICATIONS

Japanese Office Action issued to corresponding Japanese Patent Application No. 2010-072621 dated Jul. 10, 2012.

European Search Report Application No. 11002417.1 dated Nov. 16, 2012.

Second Office Action received in corresponding Chinese Patent Application No. 201110082128.3 mailed on Dec. 20, 2012.

Third Office Action issued in corresponding Chinese Patent Application No. 201110082128.3 dated Apr. 18, 2013.

Fourth Office Action issued in corresponding Chinese Patent Application No. 201110082128.3 mailed Oct. 15, 2013.

Fifth Office Action issued in corresponding Chinese Patent Application No. 201110082128.3 mailed Mar. 19, 2014.

Brother Toner Cartridge TN-210 (photos). Sales in US beginning Sep. 2009.

Dec. 21, 2015—(EP) Office Action—App 11002417.1.

* cited by examiner

13

DEVELOPER CARTRIDGE

CROSS REFERENCE TO RELATED APPLICATION

This application is a continuation of U.S. patent application Ser. No. 14/511,819 filed Oct. 10, 2014, which is a continuation of U.S. patent application Ser. No. 13/069,678 filed Mar. 23, 2011, issues as U.S. Pat. No. 8,862,013 which claims priority from Japanese Patent Application No. 2010-072621 filed Mar. 26, 2010. The entire content of the priority application is incorporated herein by reference.

TECHNICAL FIELD

The invention relates to a developer cartridge provided in an image forming device such as a laser printer.

BACKGROUND

A tandem-type color laser printer, as a color printer using an electrophotography method, provided with a plurality of photoconductors and a plurality of developer cartridges are well known in the art. In the tandem type color laser printer, the plurality of photoconductors are arranged in parallel in correspondence with toners of four colors of yellow, magenta, cyan, and black. The plurality of developer cartridges are arranged in correspondence with the photoconductors so as to feed toners to the photoconductors.

A following developer cartridge is proposed as an example of a developer cartridge provided in such a tandem-type color laser printer. That is, the developer cartridge includes a developing roller and a feed roller brought into contact with the developing roller. When the developer cartridge is attached to a drum cartridge that rotatably supports the photosensitive drum, the developer cartridge is configured to be pressed elastically against a photosensitive drum such that the developing roller is brought into elastic press-contact with the photosensitive drum.

The developer cartridge has a bias electrode brought into contact with a relay electrode provided in the drum cartridge. The bias electrode is formed of a plate spring and has a protruding portion protruding outward in the width direction of the developer cartridge toward the relay electrode of the drum cartridge.

When the developer cartridge is mounted on the drum cartridge, the protruding portion of the bias electrode is brought into press-contact with the relay electrode of the drum cartridge.

As a result, bias voltage applied from a high voltage power supply provided in a main body casing is applied to the bias electrode of the developer cartridge through the relay electrode of the drum cartridge.

SUMMARY

In the conventional developer cartridge, the bias electrode is formed as a plate spring and is brought into press-contact with the relay electrode by biasing force of the plate spring.

Thus, the press-contact of the bias electrode against the relay electrode causes friction force between the bias electrode and the relay electrode.

Meanwhile, the cross-section of the photosensitive drum is not a true circle but is eccentric within a predetermined range of tolerance. Therefore, when the photosensitive drum is rotated, the developing roller is pressed by the photosensitive drum with periodically changing pressing force of the photosensitive drum.

At this time, the developer cartridge is moved by the pressing force from the photosensitive drum so as to be away from the photosensitive drum against the pressing force to the photosensitive drum or come close to the photosensitive drum by the pressing force to the photosensitive drum, such that the developing roller follows the outer periphery of the photosensitive drum while the contacting state of the developing roller with the photosensitive drum is maintained.

However, when the friction force occurs between the bias electrode and relay electrode as described above, the above-mentioned movement of the developer cartridge may be inhibited at the side in the axial direction of the developing roller at which the bias electrode is provided.

As a result, the pressing force of the developing roller to the photosensitive drum may become nonuniform in the axial direction of the developing roller.

An object of the invention is to provide a developer cartridge capable of allowing the developing roller to uniformly press the photosensitive drum, a process unit provided with the developing roller, and an image forming device provided with the process unit.

In order to attain the above and other objects, the invention provides a developer cartridge. The developer cartridge includes a frame, a carrying member, and an electrode. The frame has one side in a first direction. The carrying member carries a toner and is rotatably supported by the frame, the carrying member extending in the first direction. The electrode is supported by one side of the frame. The electrode includes a base portion, a first extending portion, a second extending portion, and an input portion. The base portion is fixed to an outer surface of the one side of the frame, and extends from one end thereof to another end thereof in a second direction orthogonal to the first direction. The first extending portion extends from one end thereof to another end thereof in the first direction. The one end of the first extending portion is connected to the another end of the base portion. The second extending portion extends from one end thereof to another end thereof in a direction opposite to the second direction. The one end of the second extending portion is connected to the another end of the first extending portion. The input portion is connected to the another end of the second extending portion and inputs electrical power from an external device. The electrode is deformable such that a distance between the base portion and the second extending portion becomes smaller.

According to another aspect, the invention provides a process unit includes a contact part and a developer cartridge. The contact part is configure to supply electrical power. The developer cartridge includes a frame, a carrying member, and an electrode. The frame has one side in a first direction. The carrying member carries a toner and is rotatably supported by the frame, the carrying member extending in the first direction. The electrode is supported by one side of the frame. The electrode includes a base portion, a first extending portion, a second extending portion, and an input portion. The base portion is fixed to an outer surface of the one side of the frame, and extends from one end thereof to another end thereof in a second direction orthogonal to the first direction. The first extending portion extends from one end thereof to another end thereof in the first direction. The one end of the first extending portion is connected to the another end of the base portion. The second extending portion extends from one end thereof to another end thereof in a direction opposite to the second direction. The one end of the second extending portion is connected to the another end of the first extending portion. The input portion is connected to the another end of the second extending portion. The input portion contacts the contact part and inputs electrical power from the contact part. The electrode is deformable such that a distance between the base portion and the second extending portion becomes smaller.

According to still another aspect, the invention provides an image forming device. The image forming device includes a power supply and a process unit. The power supply is configured to supply electrical power. The process unit includes a contact part and a developer cartridge. The contact part is configure to supply electrical power. The developer cartridge includes a frame, a carrying member, and an electrode. The frame has one side in a first direction. The carrying member carries a toner and is rotatably supported by the frame, the carrying member extending in the first direction. The electrode is supported by one side of the frame. The electrode includes a base portion, a first extending portion, a second extending portion, and an input portion. The base portion is fixed to an outer surface of the one side of the frame, and extends from one end thereof to another end thereof in a second direction orthogonal to the first direction. The first extending portion extends from one end thereof to another end thereof in the first direction. The one end of the first extending portion is connected to the another end of the base portion. The second extending portion extends from one end thereof to another end thereof in a direction opposite to the second direction. The one end of the second extending portion is connected to the another end of the first extending portion. The input portion is connected to the another end of the second extending portion. The input portion contacts the contact part and inputs electrical power from the contact part. The electrode is deformable such that a distance between the base portion and the second extending portion becomes smaller.

BRIEF DESCRIPTION OF THE DRAWINGS

The particular features and advantages of the invention as well as other objects will become apparent from the following description taken in connection with the accompanying drawings, in which:

FIG. 4 is a perspective view showing a top-rear-right side of a developer cartridge seeing from;

FIG. 7(*b*) is a view showing a front bottom side of the electrode;

FIG. 8(*b*) is a perspective view showing a left-bottom side of the electrode cover;

FIG. 8(*c*) is a cross sectional view of the electrode cover taken along a line C-C shown in FIG. 8(*a*);

DETAILED DESCRIPTION

1. Entire Configuration of Color Laser Printer

Figure 1:
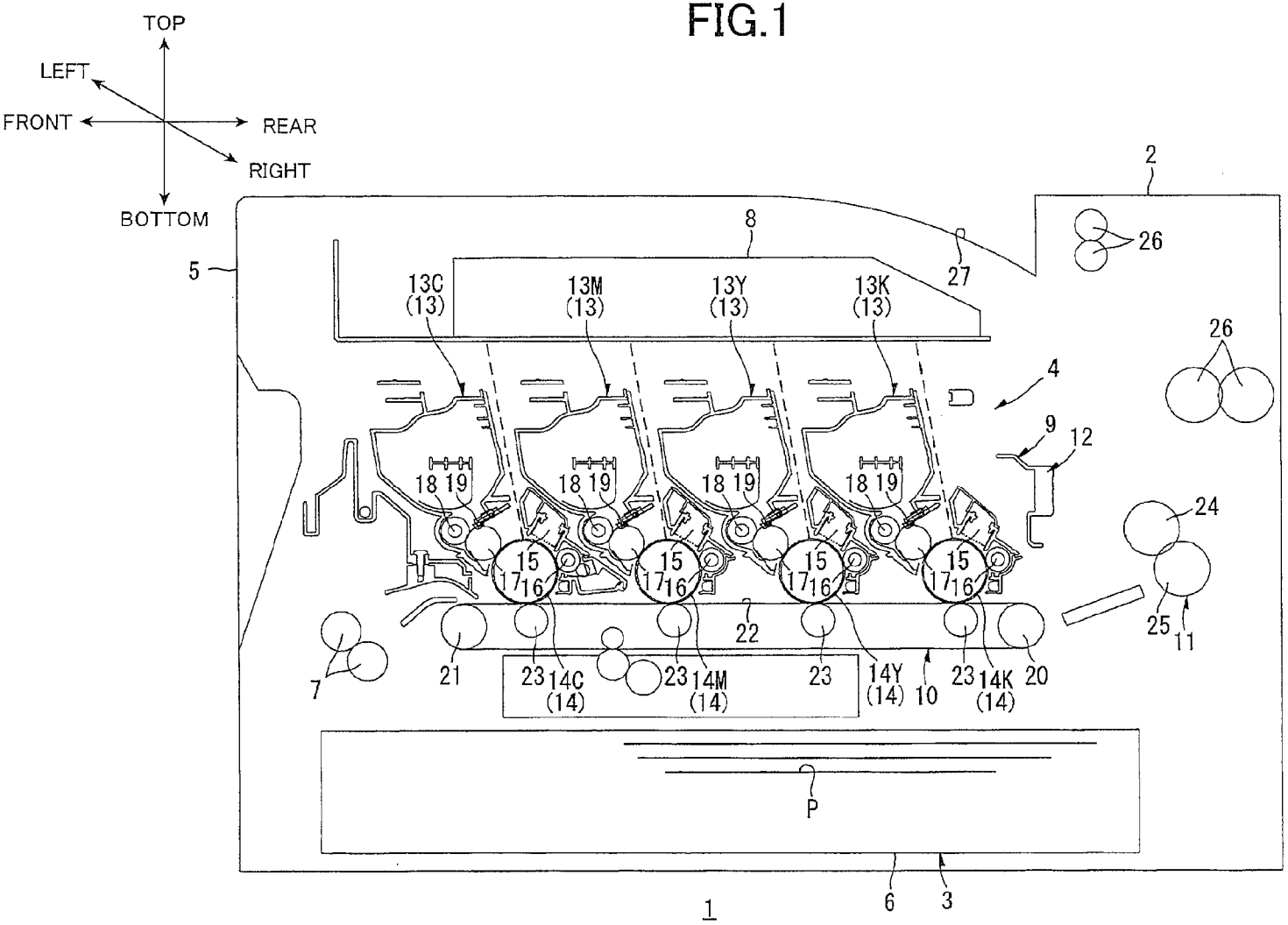
FIG. 1 is a cross sectional side view of a color laser printer according to an embodiment.

As shown in FIG. 1, a color laser printer 1 is a direct tandem type color laser printer and is laid horizontally. The color laser printer 1 has a main-body casing 2 and, within the main-body casing 2, a paper feeding section 3 for feeding a paper P, an image forming section 4 for forming an image on the fed paper P.

(1) Main-Body Casing

The main-body casing 2 has a box shape that is substantially rectangular in a side view and accommodates the paper feeding section 3 and the image forming section 4. A front cover 5 is provided on one side wall of the main-body casing 2 so as to mount or remove a process unit 9 to be described later.

The terms "upward", "downward", "upper", "lower", "above", "below", "beneath", "right", "left", "front", "rear" and the like will be used throughout the description assuming that the color laser printer 1 is disposed in an orientation in which it is intended to be used. In use, the color laser printer 1 is disposed as shown in FIG. 1. That is, the front cover 5 is provided at the front side of the color laser printer 1. In the following description, the left-right direction is referred to as a longitudinal direction.

(2) Paper Feeding Section

The paper feeding section 3 has a paper feeding tray 6 provided at the bottom of the main-body casing 2 and a pair of registration rollers 7 disposed above the front end portion of the paper feeding tray 6.

The papers P accommodated in the paper feeding tray 6 are fed one by one between the registration rollers 7 and then fed to the image forming section 4 (between a photosensitive drum 14 (to be described later) and a conveying belt 22 (to be described later)) at a predetermined timing.

(3) Image Forming Section

The image forming section 4 has a scanning unit 8, a process unit 9, a transfer unit 10, and a fixing unit 11.

(3-1) Scanning Unit

The scanning unit 8 is disposed in the upper portion of the main-body casing 2. The scanning unit 8 irradiates laser beams toward four photosensitive drums 14 (to be described later) based on image data so as to expose the photosensitive drums 14 as indicated by broken lines.

(3-2) Process Unit (3-2-1) Configuration of Process Unit

The process unit 9 is disposed below the scanning unit 8 and above the transfer unit 10. The process unit 9 has a single process frame 12 and four developer cartridges 13 corresponding to four colors. The process unit 9 is detachably mounted on the main body casing 2 by being slid in the front-rear direction relative to the main-body casing 2.

The process frame 12 is slidably movable in the front-rear direction relative to the main-body casing 2 and supports the four photosensitive drums 14, four scorotron chargers 15, and four drum cleaning rollers 16.

The four photosensitive drums 14 extend in the left-right direction and are arranged parallel to and spaced apart from one another in the front-rear direction. Specifically, the photosensitive drums 14 include a cyan photosensitive drum 14C, a magenta photosensitive drum 14M, a yellow photosensitive drum 14Y, and a black photosensitive drum 14K arranged in this order from front to rear.

The scorotron chargers 15 are disposed diagonally above and rearward of the respective photosensitive drums 14 and face the photosensitive drums 14. The scorotron chargers 15 separate from the photosensitive drums by a gap.

The drum cleaning rollers 16 are disposed rearward of the respective photosensitive drums 14 and face and contact the photosensitive drums 14.

The developer cartridges 13 are detachably supported by the process frame 12 above the corresponding photosensitive drums 14 and face the corresponding photosensitive drums 14. Specifically, a cyan developer cartridge 13C, a magenta developer cartridge 13M, a yellow developer cartridge 13Y, and a black developer cartridge 13K are arranged in this order from front to rear. Each of the developer cartridges 13 is also provided with a developing roller 17.

Although details will be described later, each developing roller 17 is rotatably supported at the lower end of the corresponding developer cartridge 13 so as to expose the bottom rear end of the developing roller 17 through a lower edge of the developer cartridge 13. The bottom rear end of each developing roller 17 contacts a top of the corresponding photosensitive drum 14.

Each of the developer cartridges 13 also has a feed roller 18 for feeding toner to the corresponding developing roller 17 and a layer thickness regulating blade 19 for regulating the thickness of the toner fed to the developing roller 17. Toner corresponding to each of the four colors is accommodated above the feed roller 18 and the layer thickness regulating blade 19.

(3-2-2) Developing Operation of Process Unit

The toner accommodated in each of the developer cartridges 13 is fed to the feed roller 18, which in turn feeds the toner to the developing roller 17. The toner is positively triboelectrically charged between the feed roller 18 and the developing roller 17.

As the developing roller 17 rotates, the layer thickness regulating blade 19 regulates the toner fed to the developing roller 17 to a prescribed thickness, so that the developing roller 17 carries a uniform thin layer of toner thereon.

The scorotron charger 15 applies a uniform charge of positive polarity to a surface of the corresponding photosensitive drum 14 while the photosensitive drum 14 rotates. Subsequently, the surface of the photosensitive drum 14 is exposed by laser beam (refer to the broken line of FIG. 1) emitted from the scanning unit 8 in a high-speed scan. As a result, an electrostatic latent image corresponding to an image to be formed on the paper P is formed on the surface of the respective photosensitive drum 14.

As the photosensitive drum 14 continues to rotate, the positively charged toner carried on the surface of the developing roller 17 is supplied to the electrostatic latent image formed on the surface of the photosensitive drum 14, thereby developing the electrostatic latent image into a visible toner image through reverse development.

(3-3) Transfer Unit

The transfer unit 10 is disposed in the main-body casing 2 above the paper feeding section 3 and below the process unit 9 and extends in the front-rear direction. The transfer unit 10 has a drive roller 20, a driven roller 21, the conveying belt 22, and four transfer rollers 23.

The drive roller 20 and the driven roller 21 are arranged spaced apart from each other in the front-rear direction. The conveying belt 22 is winded around the drive roller 20 and the driven roller 21, with a top portion of the conveying belt 22 contacting each of the photosensitive drums 14 from below. When the drive roller 20 rotates, the conveying belt 22 circulates such that the top portion of the conveying belt 22 moves from the front side to rear side.

The transfer rollers 23 are disposed at positions opposing corresponding photosensitive drums 14, with the top portion of the conveying belt 22 interposed therebetween.

When the paper P is fed from the paper feeding section 3, the conveying belt 22 conveys the paper P from the front side to the rear side such that the paper P passes sequentially through each transfer position between the photosensitive drums 14 and the corresponding transfer rollers 23. As the paper P is conveyed on the conveying belt 22, the toner images of each color carried on the respective photosensitive drums 14 are sequentially transferred onto the paper P to form a color image.

(3-4) Fixing Unit

The fixing unit 11 is disposed rearward of the transfer unit 10 and has a heating roller 24 and a pressure roller 25 arranged opposite to the heating roller 24. While the paper P passes between the heating roller 24 and the pressure roller 25, the color image transferred onto the paper P in the transfer unit 10 is fixed to the paper P by heat and pressure.

(4) Paper Discharge

The paper P onto which the toner image has been fixed is conveyed along a U-shaped discharge path (not shown) by paper discharge rollers 26. The paper discharge rollers 26 discharge the paper P onto a paper discharge tray 27 disposed above the scanning unit 8.

2. Detailed Description of Process Unit (1) Process Frame

Figure 2:
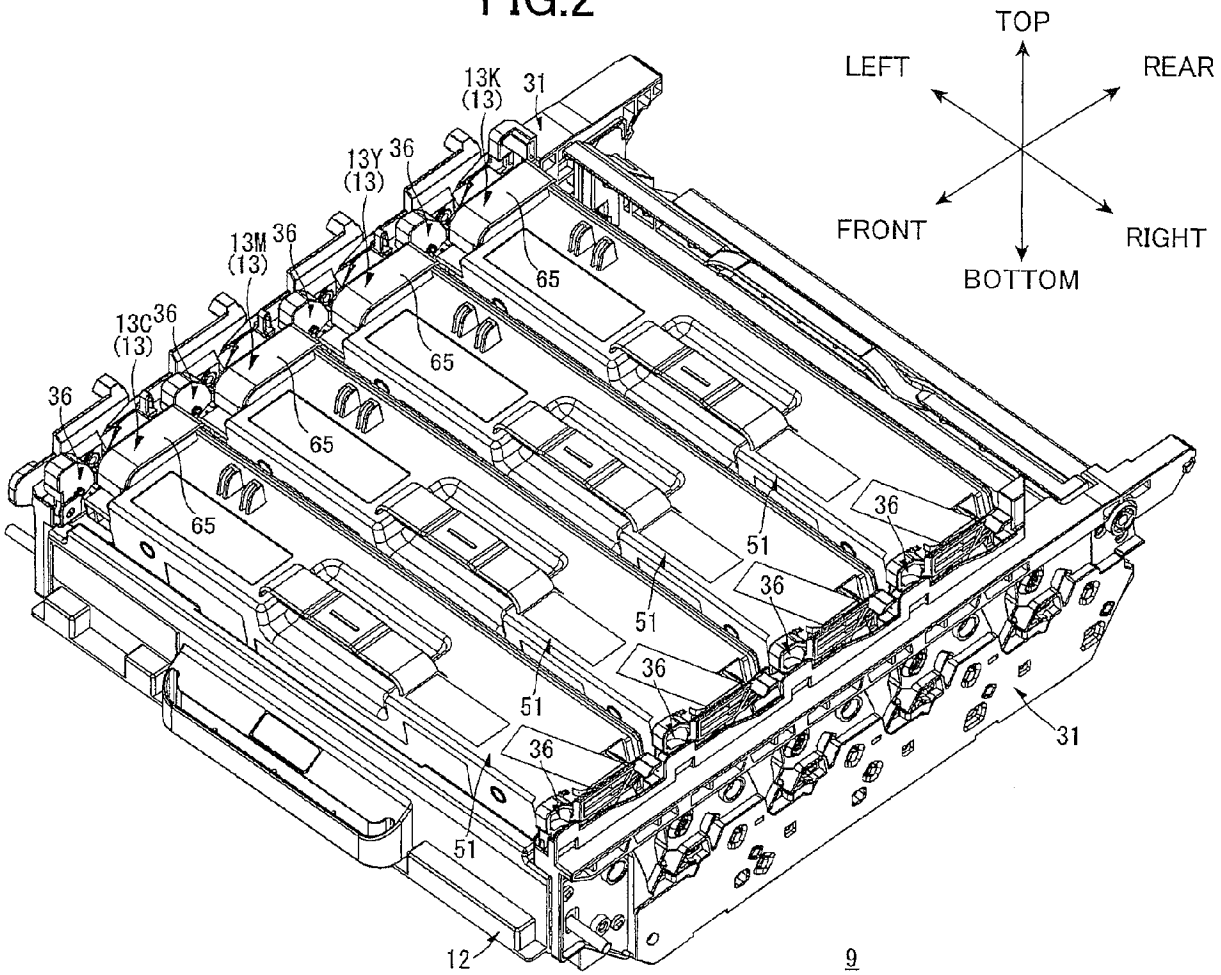
FIG. 2 is an upper-right perspective view of a process unit of the color laser printer shown in FIG. 1.

As illustrated in FIG. 2, the process frame 12 has substantially a rectangular frame shape elongated in the front-rear direction, as viewed from above. The process frame 12 has a pair of side plates 31. The side plates 31 are respectively positioned at the left and right sides of the process frame 12.

Figure 3:
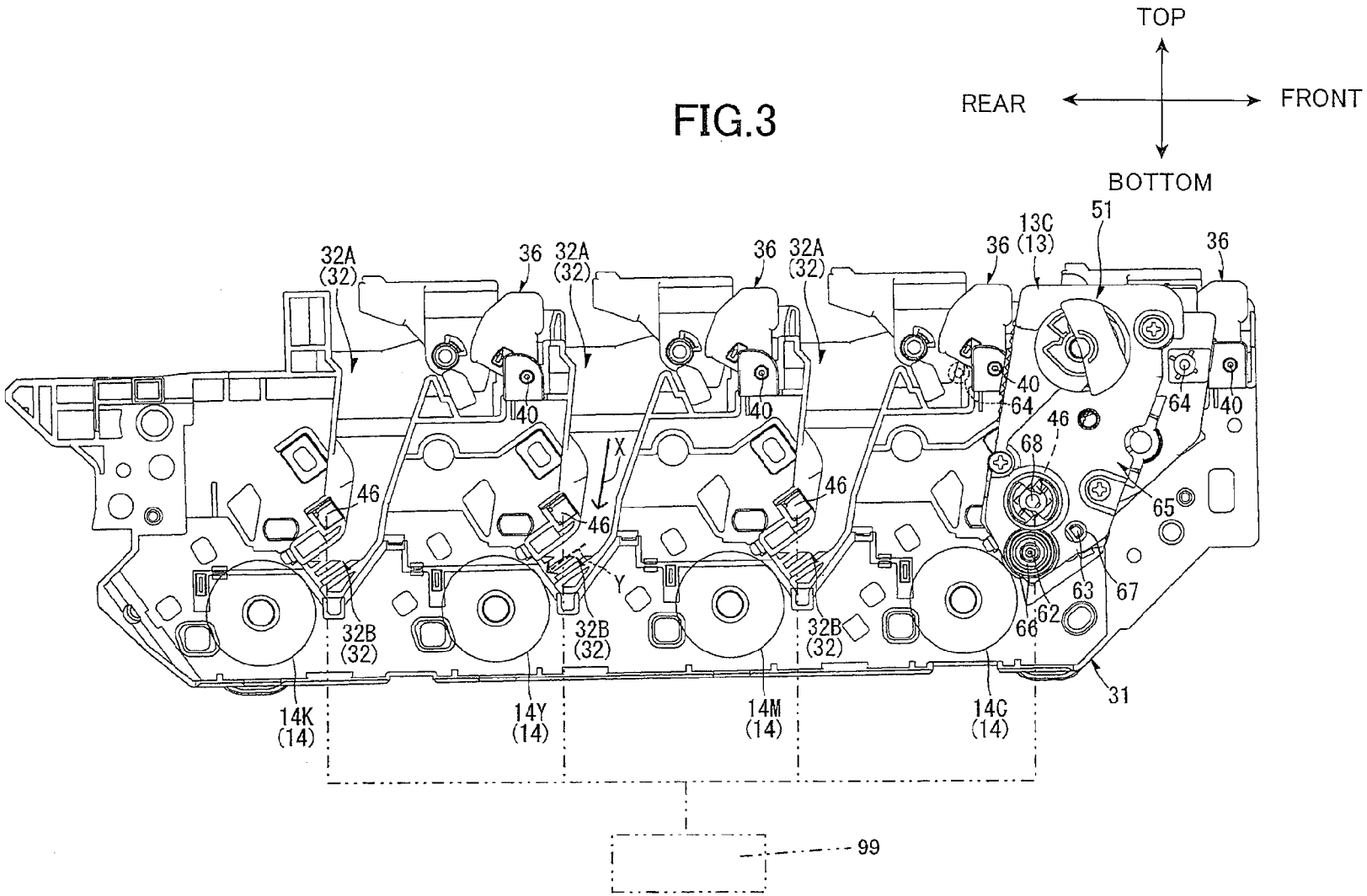
FIG. 3 is a left side view showing a right side plate of a process frame.

The side plates 31 are arranged spaced apart from each other and opposite each other in the left-right direction. As shown in FIG. 3, the both side plates 31 have substantially a rectangular shape elongated in the front-rear direction and has guide grooves 32.

In the present embodiment, a process-side electrode 46 (to be described later) is formed only in the right side plate 31. Thus, hereinafter, only the right side plate 31 will be described in detail, and the description of the left side plate 31 will be omitted. Further, the right side plate 31 is hereinafter referred to merely as the side plate 31.

The side plate 31 has four guide grooves 32 which are formed in the left surface (inner surface in the left-right direction) equally spaced apart from one another in the front-rear direction. Each guide groove 32 is formed between the upper edge of the side plate 31 and corresponding photosensitive drum 14.

Each guide groove 32 has a first guide groove 32A diagonally extending in the lower-rear direction (first inclined direction X) from the upper end portion of the side plate 31 and a second guide groove 32B which is formed continuing from the first guide groove 32A so as to extend, at a different angle from the first guide groove 32A, in the lower-rear direction (second inclined direction Y) from the lower end portion of the first guide groove 32A. That is, the guide groove 32 is bent at the boundary between the first and second guide grooves 32A and 32B. The second inclined direction Y is more inclined to the rear direction than the first inclined direction X.

A process-side electrode 46 is formed at the rear side of the boundary between the first and second guide grooves 32A and 32B. The substantially rectangular portion of the process-side electrode 46 is exposed through the left surface of the side plate 31.

The process-side electrode 46 integrally has a power receiving portion (not illustrated) exposed through the right surface of the side plate 31. When the process unit 9 is attached to the main-body casing 2, the power receiving portion (not illustrated) is electrically connected to a power supply (not illustrated) provided in the main-body casing 2.

Further, pressure cams 36 are formed in the left surface of the side plate 31 in correspondence with the respective guide grooves 32. Each pressure cam 36 has substantially a fan-like shape in the side view.

Each of the pressure cams 36 is pivotally supported about a pivot shaft 40 and is biased by a biasing member (not shown) in the counterclockwise direction as viewed from the left side.

(2) Developer Cartridge (2-1) Configuration of Developer Cartridge

Figure 4:
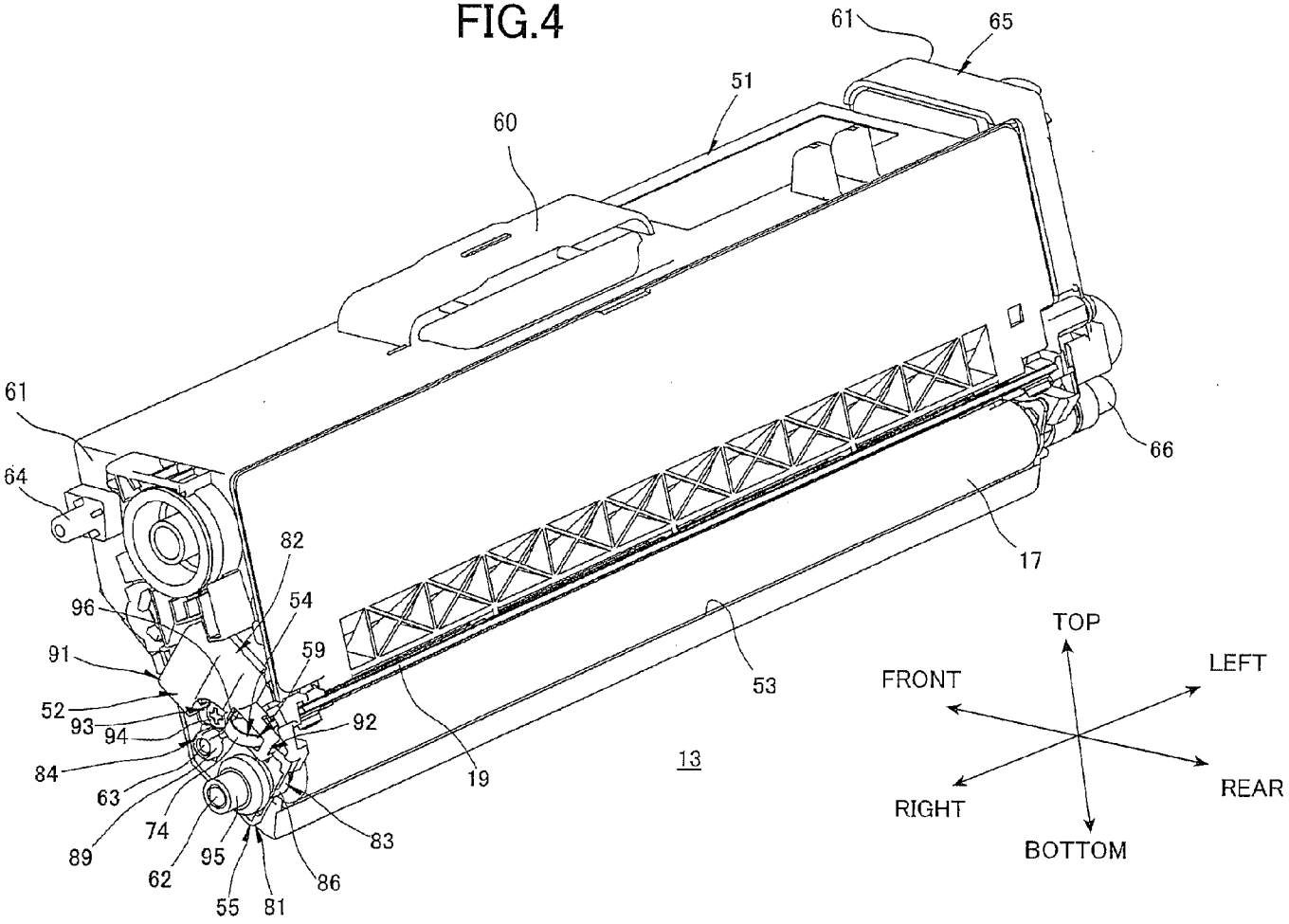

As shown in FIG. 4, each developer cartridge 13 has a frame 51, an electrode unit 52, and a drive unit 65.

The frame 51 is formed into substantially a box shape elongated in the left-right direction. In the side view, the frame 51 has an isosceles triangular cross-section having an apex angle that is directed in the lower-rear direction.

The frame 51 has a handle 60, a pair of left and right side outer surfaces 61, and a pair of left and right bosses 64. The handle 60 is positioned at the front side upper end portion of the frame 51. The side surfaces 61 are located at both ends of the frame 51 in the left-right direction. Each bosses 64 protrudes outward from the respective side surface 61. Further, the frame 51 has an opening portion 53 in the rear-side lower end portion.

The bosses 64 are formed on the left and right end surfaces 61 of the frame 51 in substantially cylindrical shapes protruding outside in the left and right directions.

The opening portion 53 extends over the entire left-right direction of the frame 51 and is opened rearward.

Figure 5:
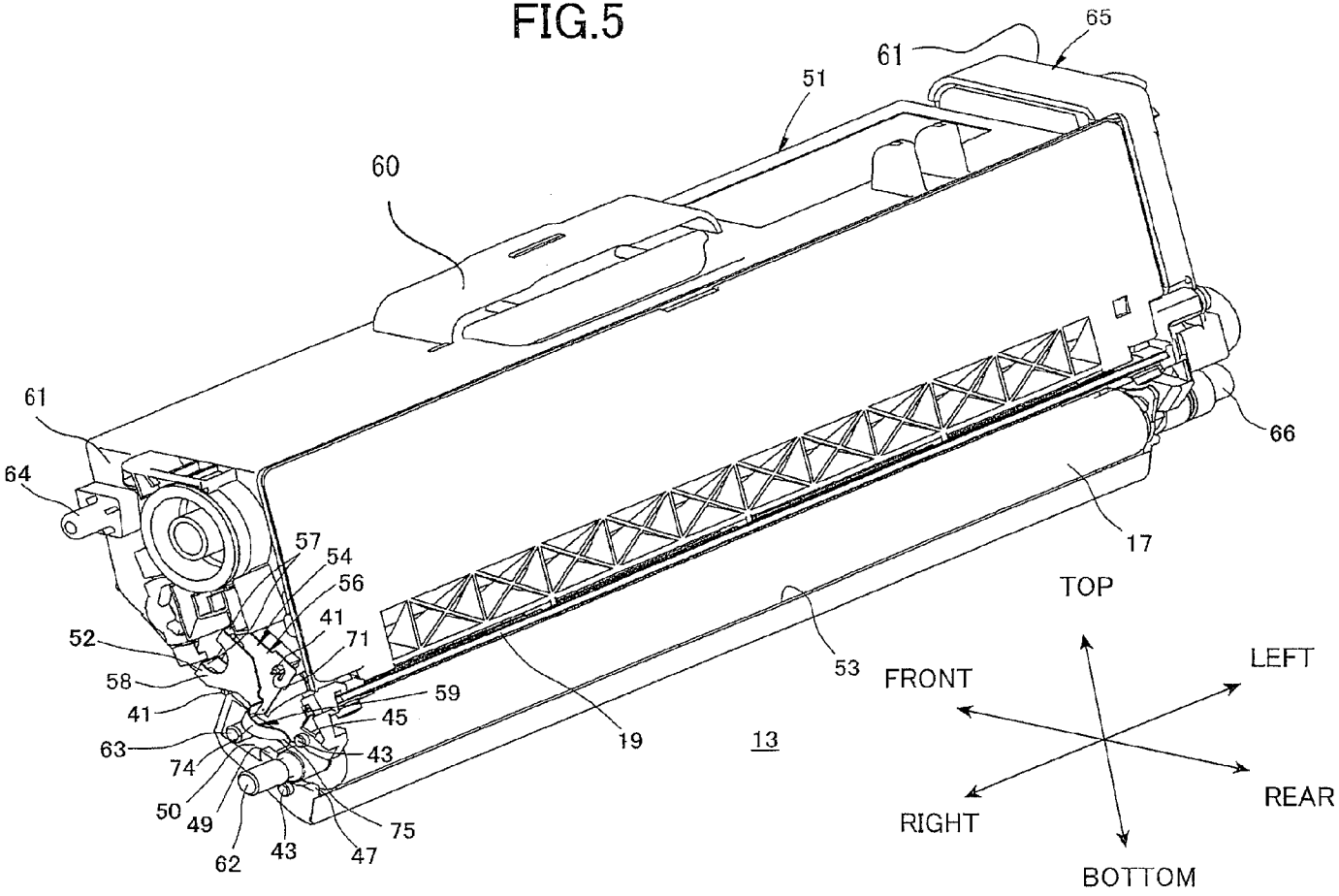
FIG. 5 is a perspective view showing a top-rear-right side of a developer cartridge when an electrode cover is detached.
Figure 6:
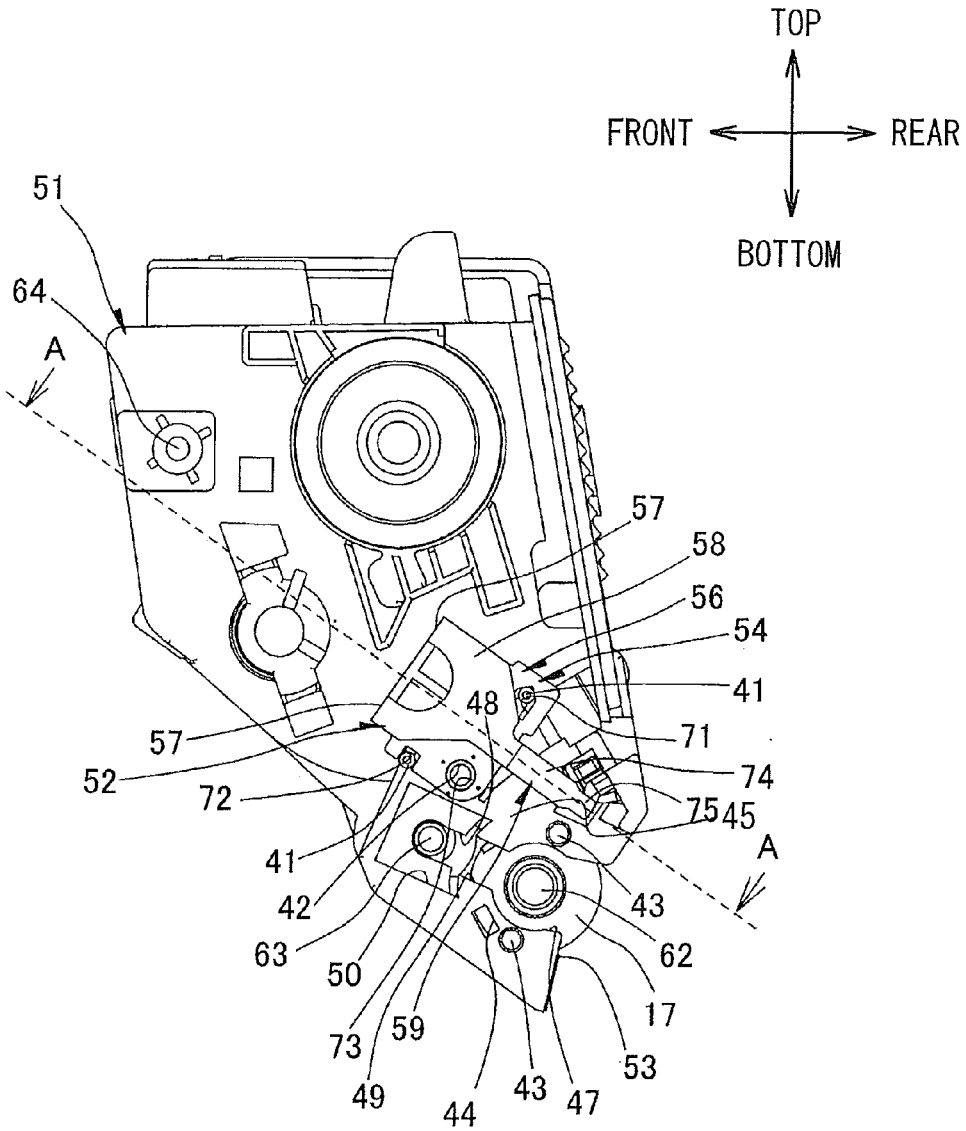
FIG. 6 is a right side view of the developer cartridge.

Further, as shown in FIGS. 5 and 6, a developing roller shaft inserting groove 47, a communication groove 49, a feed roller shaft inserting groove 48, and a feed roller bearing fitting portion 50 are formed in the right wall of the frame 51.

In the side view, the developing roller shaft inserting groove 47 is formed in a substantial U-shape at the lower end portion of the frame 51. The developing roller shaft inserting groove 47 cutouts to extend from the rear edge of the frame 51 toward the front side thereof and is opened rearward.

In the side view, the communication groove 49 is formed in a substantially linear shape continuing from the front end portion of the developing roller shaft inserting groove 47 and extend in the front-rear direction.

In the side view, the feed roller shaft inserting groove 48 is formed in a substantial U-shape continuing from the front end portion of the communication groove 49 and being opened at the rear side thereof.

In the side view, the feed roller bearing fitting portion 50 is formed in a substantially rectangular shape that is recessed to the left from the right surface of the frame 51. When projected in the left-right direction, the feed roller bearing fitting portion 50 is disposed such that the front end portion of the feed roller shaft inserting groove 48 is located at substantially the center of the feed roller bearing fitting portion 50.

Further, a pair of electrode positioning bosses 41 and a pair of cover positioning bosses 43 are formed on the right wall of the frame 51. Further, a cover engaging through-hole 44, a screw hole 42, and a receiving portion 45 are formed on the right wall of the frame 51.

The electrode positioning bosses 41 are apart from each other above the developing roller shaft inserting groove 47 and the feed roller shaft inserting groove 48 such that the interval between the electrode positioning bosses 41 corresponds to the lengths of a base portion 56 of an electrode plate 54 (to be described later) in the front-rear direction. Further, both of the electrode positioning bosses 41 are substantially formed in a cylindrical shape protruding to the right side from the right wall of the frame 51.

The cover positioning bosses 43 sandwich the front side portion of the developing roller shaft inserting groove 47 therebetween in the upper-lower direction. Further, the cover positioning bosses 43 are formed in a substantially cylindrical shape protruding to the right side from the right wall of the frame 51.

In the side view, the cover engaging through-hole 44 is formed in a substantially rectangular shape at the front side of the lower-side cover positioning boss 43.

The screw hole 42 is formed above the feed roller bearing fitting portion 50 at the lower-rear side of the front-side electrode positioning boss 41 and at the lower-front side of the rear-side electrode positioning boss 41.

In the side view, the receiving portion 45 is formed in a substantially rectangular shape above the upper-side cover positioning boss 43. The receiving portion 45 is recessed to the left from the right surface of the frame 51. When projected in the left-right direction, the receiving portion 45 is formed at a position overlapping an engagement portion 75 (to be described later) of an electrode plate 54 (to be described later). Further, when projected in the left-right direction, the receiving portion 45 is disposed between the developing roller 17 and the layer thickness regulating blade 19.

The electrode unit 52 is provided on the right end portion of the frame 51 and has an electrode plate 54 and an electrode cover 55 (refer to FIG. 4).

Figure 7A:
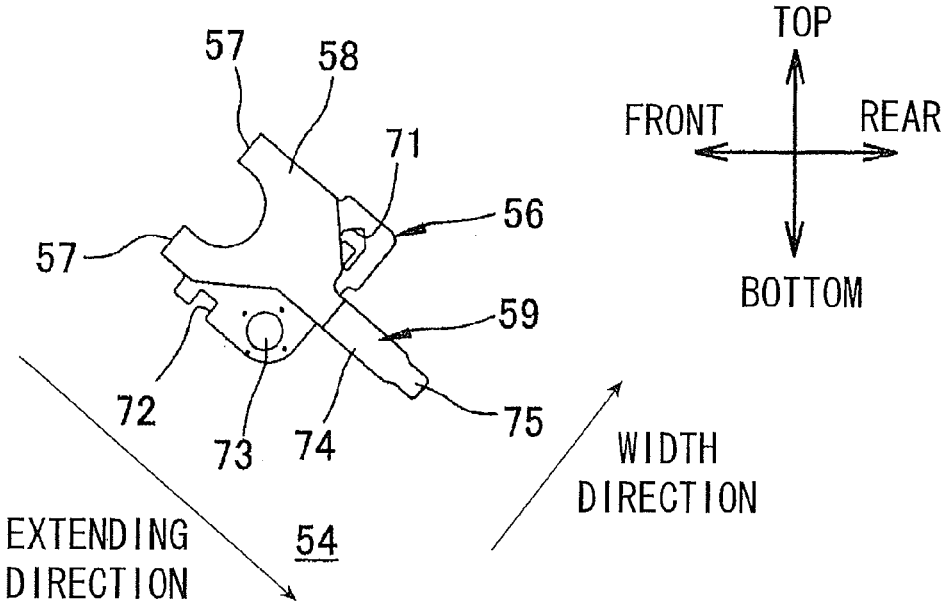
FIG. 7(*a*) is a right side view showing a right side of an electrode plate of the developer cartridge shown in FIG. 6.
Figure 7B:
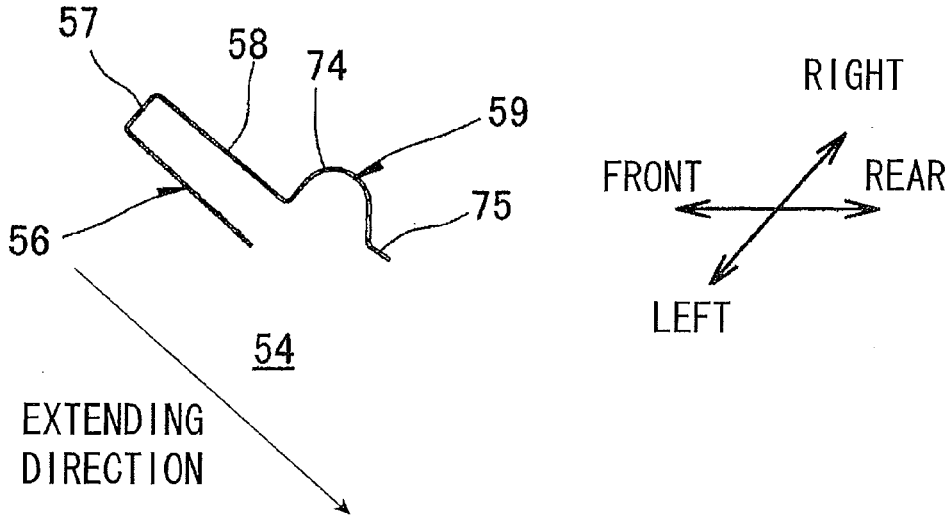

As shown in FIGS. 7(*a*) and 7(*b*), the electrode plate 54 is formed from a metal plate and has a substantially rectangular shape as viewed from the right side.

More specifically, the electrode plate 54 integrally has a base portion 56, a pair of first extending portions 57, a second extending portion 58, and an input portion 59.

In the side view, the base portion 56 is formed in a substantially rectangular flat plate shape extending in an extending direction that is orthogonal to the longitudinal direction and that is oriented from the upper-front side to the lower-rear side. The base portion 56 has a predetermined width in a width direction that is orthogonal to the longitudinal direction and the extending direction and that is therefore oriented from the lower-front side to the upper-rear side. Further, a positioning through-hole 71, a positioning groove 72, and a screw insertion through-hole 73 are formed at a bottom rear end portion of the base portion 56.

In the side view, the positioning through-hole 71 is formed in a substantially rectangular shape at the rear end portion of the base portion 56 and penetrates the base portion 56. The positioning groove 72 is formed in a substantially rectangular shape at the front end portion of the base portion 56 and extends from the lower-front side to the upper-rear side. In the side view, the screw insertion through-hole 73 is formed in a substantially circular shape at the lower end portion of the base portion 56 and penetrates the base portion 56.

The pair of first extending portions 57 and located and formed in a substantially flat plate shape. Each of the first extending portions 57 is connected to the respective width end of the base portion 56 in the width direction. Each of the first extending portion 57 extends to the right direction from the upper-front side end portion of the base portion 56.

In the side view, the second extending portion 58 is formed substantially U-shaped and extending from the right end portions of the both first extending portions 57 to the lower-rear side. The upper-front side of the second extending portion 58 is opened so as to connect the both first extending portions 57. The upper-rear side end portion of the second extending portion 58 is cut out so as to expose the positioning through-hole 71 to the right side. The lower-front side end portion of the second extending portion 58 is cut out so as to expose the screw insertion through-hole 73. Further, the second extending portion 58 is opposed to the base portion 56 in the left-right direction.

As viewed form the side, the input portion 59 is substantially located at a center of the second extending portion 58 in the width direction. The input portion 59 is formed in a substantially rectangular shape extends from the lower-rear side end portion of the second extending portion 58 to the lower-rear side. Further, the input portion 59 has a contact portion 74 and an engagement portion 75.

As shown in FIG. 7(*b*), the contact portion 74 is curved substantially in a U-shape continuing from the lower-rear side end portion of the second extending portion 58 and protruding to the right with the left side thereof is opened. More specifically, the contact portion 74 extends from the lower-rear side end portion of the second extending portion 58 to the right and curved in substantially a U-shape toward the lower-rear side.

As shown in FIG. 7(*a*), the engagement portion 75 is formed in a substantially rectangular shape extending from the lower-rear side end portion of the contact portion 74 to the lower-rear side. Further, as shown in FIG. 7(*b*), the engagement portion 75 is inclined to the right as the engagement portion 75 extends from the lower-rear end portion of the contact portion 74 to the lower-rear side.

Figure 8A:
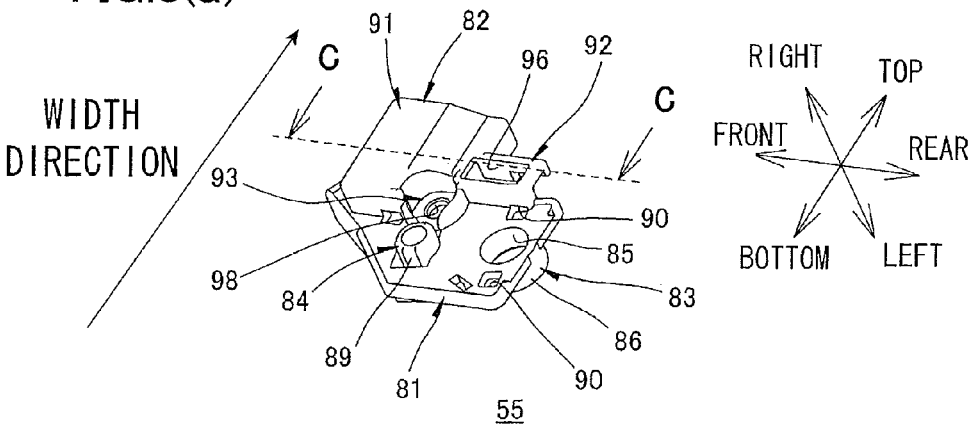
FIG. 8(*a*) is a perspective view showing a right-rear-bottom side of the electrode cover.
Figure 8B:
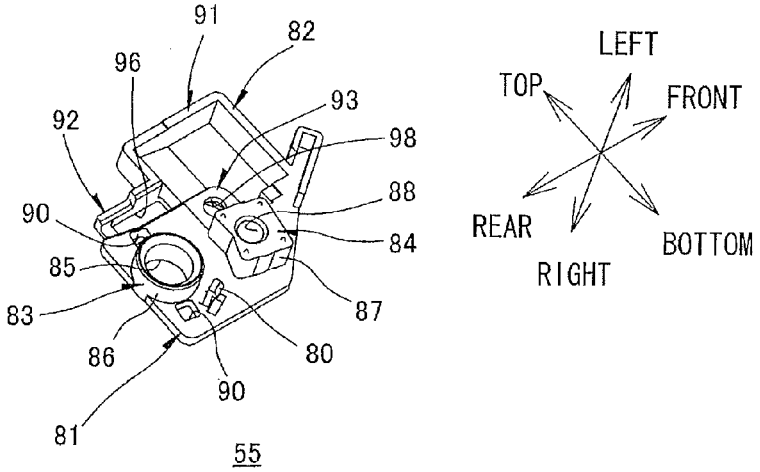
Figure 8C:
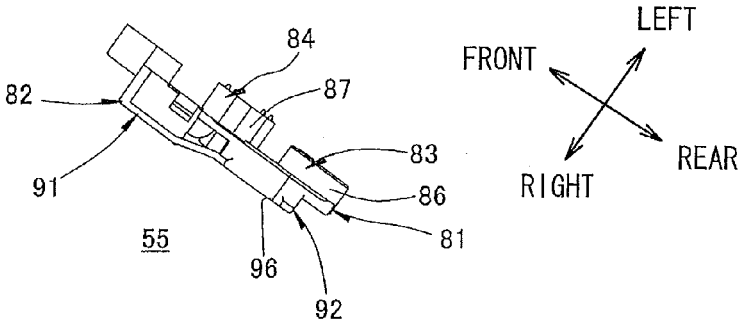
Figure 9:
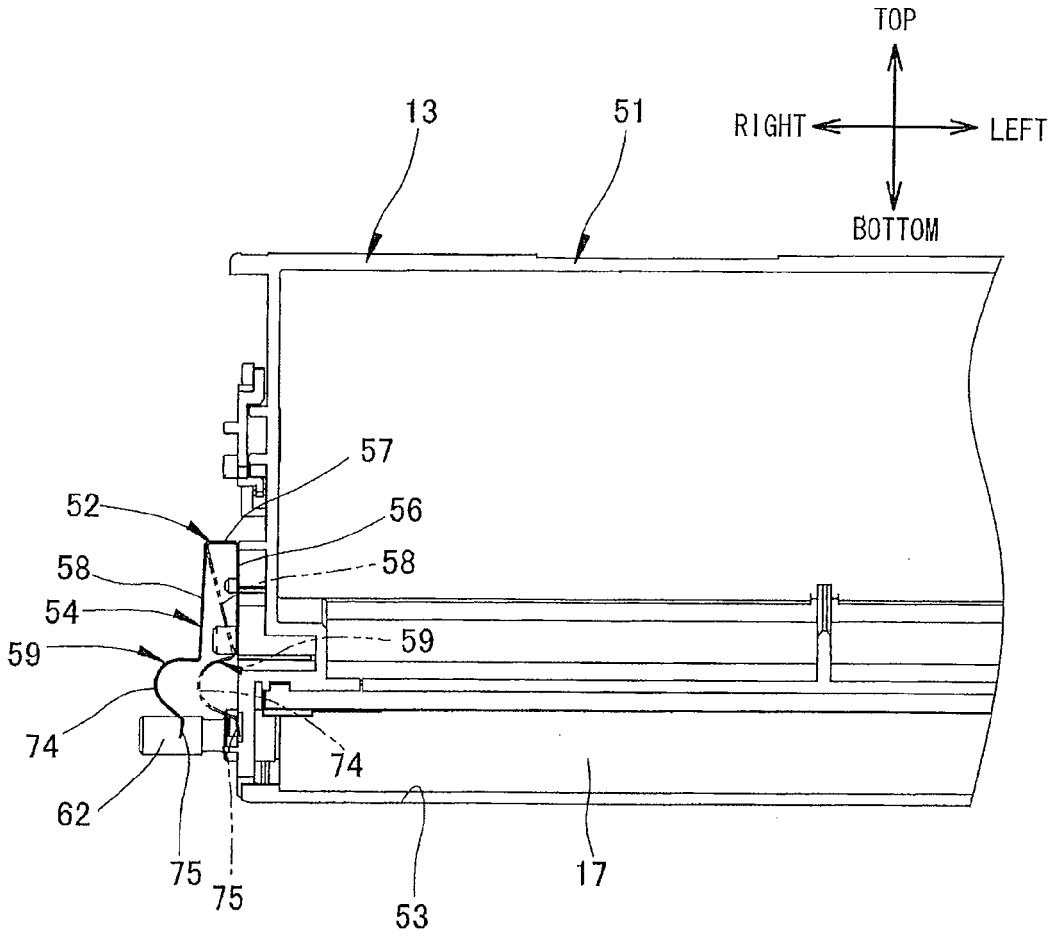
FIG. 9 is a cross sectional view of the developer cartridge taken along a line A-A shown in FIG. 6.

As shown in FIGS. 8(*a*) and 8(*b*), the electrode cover 55 is formed of a conductive material such as a conductive resin and integrally has a bearing portion 81, an electrode supporting portion 82 that is provided above the bearing portion 81 and supports the electrode plate 54.

The bearing portion 81 has an electrode side developing bearing portion 83 and an electrode side feed bearing portion 84.

The electrode side developing bearing portion 83 is provided at the rear end portion of the bearing portion 81, and has a developing roller shaft insertion thorough-hole 85 and a developing roller shaft supporting portion 86.

In the side view, the developing roller shaft insertion through-hole 85 is formed in a substantially circular shape and penetrates the bearing portion 81 in the left-right direction.

The developing roller shaft supporting portion 86 is formed in a substantially cylindrical shape around the developing roller shaft insertion through-hole 85 and extends from the left surface of the bearing portion 81 to the left. The inner diameter of the developing roller shaft supporting portion 86 is substantially the same as the diameter of the developing roller shaft insertion through-hole 85. The outer diameter of the developing roller shaft supporting portion 86 is made slightly smaller than the diameter of the developing roller shaft inserting groove 47 (FIG. 6) and is fitted to the front side portion of the developing roller shaft inserting groove 47.

The electrode side feed bearing portion 84 is disposed in parallel to and spaced apart from the electrode side developing bearing portion 83 at the front side of the electrode side developing bearing portion 83 and has a feed roller shaft supporting portion 87, a feed roller shaft insertion hole 88, and a feed roller shaft collar portion 89.

As shown in FIG. 8(*b*), the feed roller shaft supporting portion 87 is formed in a substantially prism shape protruding from the left surface of the bearing portion 81 to the left direction. Further, the feed roller shaft supporting portion 87 is formed in a substantially rectangular shape in the side view, so as to have a size corresponding to the feed roller bearing fitting portion 50 for fitting to the feed roller bearing fitting portion 50.

The feed roller shaft insertion hole 88 is formed in a substantially circular shape in the side view, is located at substantially the center of the feed roller shaft supporting portion 87, and penetrates the feed roller shaft supporting portion 87 in the left-right direction.

As shown in FIG. 8(*a*), the feed roller shaft collar portion 89 is located at a peripheral side of the feed roller shaft insertion hole 88. The feed roller shaft collar portion 89 is formed in a substantially cylindrical shape extending from the right surface of the bearing portion 81 to the right direction. The inner diameter of the feed roller shaft collar portion 89 is substantially the same as the diameter of the feed roller shaft insertion hole 88.

Further, the bearing portion 81 has a pair of cover positioning through-holes 90. Further, the bearing portion 81 has an engaging claw 80.

The cover positioning through-holes 90 sandwiches the developing roller shaft insertion through-hole 85 in the upper-lower direction. Further, the cover positioning through-holes 90 penetrate the bearing portion 81 and are formed in a substantially rectangular shapes in the side view such that the cover positioning bosses 43 of the frame 51 (see FIG. 5) are inserted to the cover positioning through-holes 90.

As shown in FIG. 8(*b*), the engaging claw 80 is formed at the front side of the lower-side cover positioning through-hole 90. The engaging claw 80 protrudes from the left surface of the bearing portion 81 to the left direction and is curved in a hook-like manner at the left end portion.

The electrode supporting portion 82 is disposed above the electrode side developing bearing portion 83 and has a covering portion 91, an exposing portion 92, and a screw thread portion 93.

The covering portion 91 is formed in a substantially rectangular frame shape whose right side is closed and whose left side is opened. The covering portion 91 covers the first extending portions 57 and the second extending portion 58 (FIGS. 7 (*a*) and 7(*b*)). Specifically, the covering portion 91 has a length in the left-right direction longer than the length of the first extending portions 57 in the left-right direction. Further, the covering portion 91 has a length in the width direction longer than the length of the second extending portion 58 in the width direction and a length in the extending direction longer than the length of the second extending portion 58 in the extending direction. Further, the right wall of the covering portion 91 is formed such that a front side half portion of the covering portion 91 extends along the front-rear direction and a remaining rear side portion of the covering portion 91 continuing from the front side half portion is inclined with respect to the left rear direction.

The exposing portion 92 is formed in a substantially rectangular frame shape elongated in the front-rear direction at the rear side of the covering portion 91 and continues from substantially the center in the width direction of the covering portion 91. The right side of the exposing portion 92 is closed and the left side of the exposing portion 92 is opened.

The electrode supporting portion 82 has an exposing thorough-hole 96.

The exposing thorough-hole 96 is formed in a substantially rectangular shape extending in the front-rear direction in the side view and penetrates the right wall of the exposing portion 92 in the left-right direction. Further, the exposing thorough-hole 96 has a length in the front-rear direction capable of receiving (inserting) the contact portion 74 (see FIG. 4).

As shown in FIGS. 3 and 4, the drive unit 65 is provided at the left end portion of the frame 51 and has a drive side developing bearing portion 66, a drive side feed bearing portion 67, and a coupling member 68.

The drive side developing bearing portion 66 is formed in a substantially cylindrical shape at the lower end portion of the drive unit 65 and extends in the left-right direction. The drive side developing bearing portion 66 has an inner diameter capable of receiving a developing roller shaft 62 (described later).

As shown in FIG. 3, the drive side feed bearing portion 67 is formed in substantially annular shape in the side view and is disposed in parallel to and spaced apart from the drive side developing bearing portion 66 at the upper-front side of the drive side developing bearing portion 66. The inner diameter of the drive side feed bearing portion 67 is smaller than that of the drive side developing bearing portion 66. The drive side feed bearing portion 67 has an inner diameter capable of receiving (inserting) a feed roller shaft 63 (described later).

The coupling member 68 is a substantially cylindrical shaped coupling female member and is rotatably supported at the left wall of the frame 51. When the developer cartridge 13 is mounted to the main-body casing 2, a coupling male member (not shown) is coupled from the left to the left end portion of the coupling member 68, whereby drive force is input to the drive unit 65 from the a drive source (not shown) of the main-body casing 2. Further, in the drive unit 65, the coupling member 68 transmits the drive force to the developing roller 17 and the feed roller 18 through gears (not shown).

As shown in FIG. 3, the left end portion of the developing roller shaft 62 is rotatably supported by the drive side developing bearing portion 66, and as shown in FIG. 4, the right end portion of the developing roller shaft 62 is rotatably supported by the electrode side developing bearing portion 83 of the electrode unit 52. With the above configuration, the developing roller 17 is rotatably supported by the frame 51.

Further, as shown in FIG. 3, the left end portion of the feed roller shaft 63 is rotatably supported by the drive side feed bearing portion 67, and as shown in FIG. 4, the right end portion of the feed roller shaft 63 is rotatably supported by the electrode side feed bearing portion 84 of the electrode unit 52. With the above configuration, the feed roller 18 is rotatably supported by the frame 51.

(2-2) Assembling Electrode Unit

When the electrode unit 52 is mounted to the frame 51, the electrode plate 54 is mounted to the frame 51.

When the electrode plate 54 is mounted to the frame 51, the electrode plate 54 is disposed on the right side of the frame 51 with the base portion 56 positioned on the left side. Then, the electrode plate 54 is mounted to the frame 51 from the right such that the electrode positioning through-hole 71 of the electrode plate 54 is fitted around the rear-side electrode positioning boss 41 of the frame 51 (FIG. 6), and the electrode positioning groove 72 of the electrode plate 54 is fitted around the front-side electrode positioning boss 41 of the frame 51. That is, the bottom rear end portion of the base portion 56 is fixed to the frame 51.

Next, the electrode cover 55 is mounted to the frame 51 for covering the electrode plate 54.

When the electrode cover 55 is mounted to the frame 51, the electrode cover 55 is disposed on the right side of the frame 51.

Then, the electrode supporting portion 82 is positioned relative to the frame 51 such that the covering portion 91 covers the second extending portion 58 and the exposing thorough-hole 96 receives the contact portion 74 (that is, the contact portion 74 is inserted to the exposing through-hole 96). Simultaneously, the bearing portion 81 is positioned relative to the frame 51 such that the both cover positioning through-holes 90 are fitted around the corresponding cover positioning bosses 43 of the frame 51 and such that the engaging claw 80 engages the cover engaging through-hole 44 of the frame 51. After that, the electrode cover 55 is mounted to the frame 51 from the right.

Figure 10:
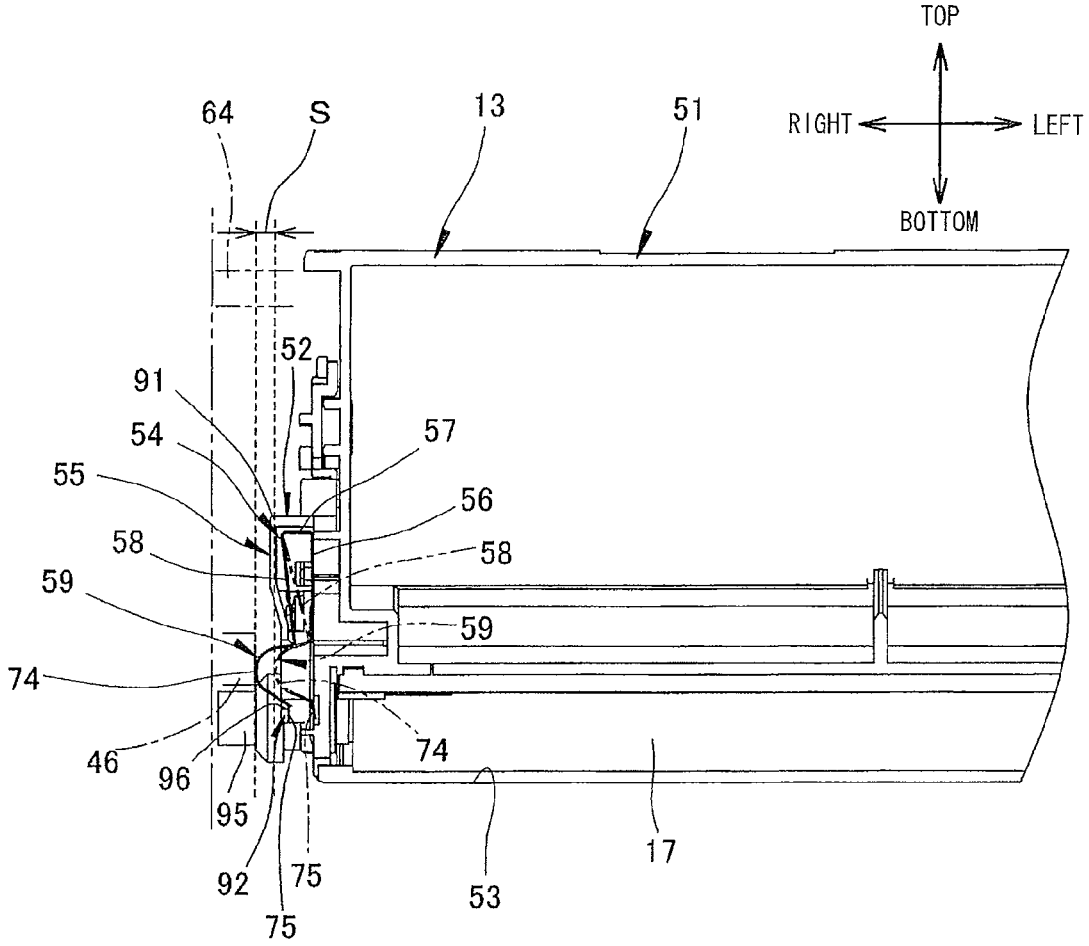
FIG. 10 is a cross sectional view of the developer cartridge taken along the line A-A shown in FIG. 6 when the electrode cover is mounted.

At this time, as shown in FIG. 10, the rear end portion of the exposing portion 92 contacts to and is pressed by the engagement portion 75 from the right. The rear end portion of the covering portion 91 contacts to and is pressed by the second extending portion 58 from the right. As a result, the second extending portion 58 and the input portion 59 are bent against the biasing force of the electrode plate 54 so as to be brought close to the base portion 56 and are moved to the left.

At this time, the front side portion of the covering portion 91 is opposed to the second extending portion 58 with a predetermined interval therefrom in the left-right direction. Further, the screw hole 42 of the frame 51 is exposed through the screw insertion hole 98.

Then, the screw 94 is screwed into the screw hole 42 through the screw insertion hole 98 and the screw insertion through-hole 73. As a result, the mounting of the electrode unit 52 to the frame 51 is completed.

3. Mount of Developer Cartridge to Main-Body Casing (1) Attachment/Detachment of Developer Cartridge to/from Process Unit As shown in FIG. 3, for mounting the developer cartridge 13 to the main-body casing 2, the developer cartridge 13 is mounted to the process frame 12.

When the developer cartridge 13 is mounted to the process frame 12, the developer cartridge 13 is disposed above the process frame 12 pulled out of the main-body casing 2 at a position corresponding to the corresponding photosensitive drum 14 in the front-rear direction. Then, the developer cartridge 13 is inserted down into the process frame 12 from the lower end portion thereof.

Then, as the developer cartridge 13 is inserted into the process frame 12, the both end portions of the developing roller shaft 62 in the left-right direction are fitted from the above to the first guide groove 32A of the corresponding guide groove 32 formed in the both side plates 31 of the process frame 12.

As a result, the developer cartridge 13 is inserted into the process frame 12, with the both end portions of the developing roller shaft 62 in the left-right direction guided by the first guide groove 32A in the first inclined direction X. That is, the developer cartridge goes slightly rearward as the developer cartridge 13 goes downward.

When the developer cartridge 13 is further inserted into the process frame 12 after the both end portions of the developing roller shaft 62 in the left-right direction reaches the lower end portion of the first guide groove 32A, the both end portions of the developing roller shaft 62 in the left-right direction is guided by the second guide groove 32B in the second inclined direction Y, and reaches the deepest portion of the second guide groove 32B. At this time, the bosses 64 are opposed to the pressure cams 36 from the upper-rear side.

Then, the developer cartridge 13 is pivoted to the front side. As a result, the developer cartridge 13 pivots to the front side about the developing roller shaft 62. Then, the bosses 64 go into the lower side of the pressure cams 36 such that the pressure cams 36 pivot to the front side.

When the bosses 64 have gone into the lower side of the pressure cams 36 (indicated by the broken line in FIG. 3), the pressure cams 36 are engaged with the bosses 64 from the above and press the bosses 64 to the lower-rear side by the biasing force of a biasing means (not shown). That is, the developer cartridge 13 is pressed to the lower-rear side by the pressure cams 36.

Thus, the developer cartridge 13 is completely mounted to the process frame 12. Subsequently, other developer cartridges 13 are mounted to the process frame 12 according to the same procedure.

The cross-section of the photosensitive drum 14 is not a true circle but is eccentric within a predetermined range of tolerance. Therefore, when the photosensitive drum 14 is rotated, the developing roller 17 is pressed by the photosensitive drum 14 with periodically changing pressing force.

On the other hand, the pressure cams 36 press the bosses 64 of the developer cartridge 13 allowing the developer cartridge 13 to move in accordance with the pressing force from the photosensitive drum 14.

As shown in FIG. 10, when the developer cartridge 13 is completely mounted to the process frame 12, the contact portion 74 contacts the process-side electrode 46 from the left.

Thus, when the developer cartridge 13 is pressed to the right, the contact portion 74 is moved to the left by the reactive force from the process-side electrode 46 (indicated by the dotted line in FIG. 10). Further, when projected in the pressing force direction of the pressure cams 36 (lower-rear direction), the pressure cam 36 presses a portion of the boss 64 that overlaps a moving range S within which the right end portion of the contact portion 74 moves. The process-side electrode 46 moves in the moving range S between the outward end of the boss 64 and the right side surface 61. In the embodiment, the pressure cam 36 partially presses the portion of the boss 64 within the moving region S. However, the pressure cam 36 may press all the portion of the boss 64 within the moving region S.

The developer cartridge 13 is detached from the process frame 12 according to a procedure reverse to the abovementioned procedure for mounting the developer cartridge 13 to the process frame 12.

(2) Attachment/Detachment of Process Unit to/from Main-Body Casing

The process unit 9 (that is, the process frame 12 to which all the developer cartridges 13 have been mounted) is mounted to the main-body casing 2. When the process unit 9 is mounted to the main-body casing 2, the process unit 9 is inserted into the main-body casing 2 toward the rear side.

Then, when the process unit 9 is completely inserted into the main-body casing 2 as shown in FIG. 1, the photosensitive drums 14 contact the conveying belt 22 from the above. Thereafter, the front cover 5 is swingably moved rearward to close the inner space of the main-body casing 2.

Thus, the attachment of the process unit 9 to the main-body casing 2 is completed.

When the process unit 9 mounted to the main-body casing 2 is detached therefrom, the front cover 5 is swingably moved frontward, and the process unit 9 is pulled out frontward.

(3) Supply of Power

When the developer cartridge 13 is mounted to the main-body casing 2, a coupling male member (not shown) provided in the main-body casing 2 is coupled from the left to the left end side of the coupling member 68. The developer cartridge 13 is pressed to the right by the coupling male member (not shown), and then the contact portion 74 of the developer cartridge 13 is pressed toward the process-side electrode 46 of the side plate 31. At this time, as shown in FIG. 10, the input portion 59 is moved to the left within a range between the right end portion of the boss 64 and the right end portion of the frame 51 (right side surface 61) by the reactive force from the process-side electrode 46.

Further, power is supplied to a power receiving portion (not shown) of the process-side electrode 46 from a power supply 99 (FIG. 3) of the main-body casing 2. Then, the power is supplied from the process-side electrode 46 to the electrode plate 54.

The power supplied to the electrode plate 54 is then supplied to the developing roller shaft 62 and the feed roller shaft 63 through the electrode cover 55. Thus, the same bias is applied to the developing roller 17 and the feed roller 18 simultaneously.

4. Effect (1) According to the developer cartridge 13, as shown in FIGS. 7(*a*), 7(*b*), the electrode plate 54 has the base portion 56 which is fitted to the frame 51, the first extending portions 57, the second extending portion 58 extending from the right end portion of the first extending portions 57 to the lower-rear side, and the input portion 59. The electrode plate 54 is bended (deformed) such that the base portion 56 and the second extending portion 58 are brought closer to each other in the left-right direction.

The electrode plate 54 can be deformed largely in the left-right direction by an extension of the first extending portion 57 to the right. That is, the electrode plate 54 can be reduced in rigidity and increased in deformation amount.

Thus, because the biasing force of the electrode plate 54 is reduced, the friction force occurring between the electrode plate 54 and the process unit 9 can be reduced after the developer cartridge 13 is mounted to the process unit 9.

As a result, even if the photosensitive drum 14 presses the developing roller 17 with the pressing force changing periodically due to the eccentricity of the photosensitive drum 14, and the developer cartridge 13 is moved such that the developing roller 17 follows the outer periphery of the photosensitive drum 14 while the developing roller 17 keeps contacting with the photosensitive drum 14, the friction force does not inhibit the movement of the developer cartridge 13. As a result, the developer roller 17 can uniformly and constantly be pressed against the photosensitive drum 14.

(2) Further, according to the developer cartridge 13, shown in FIG. 6, the base portion 56 is fitted to (is fixed to) the frame 51 at the lower-rear end portion thereof.

Thus, when the input portion 59 is moved to the left, the upper-front end portion of the base portion 56 can be separated from the frame 51.

Thus, the biasing force of the electrode plate 54 can be reduced further by the separation of the upper-front end portion of the base portion 56, so that the friction force occurring between the electrode plate 54 and the process unit 9 after the developer cartridge 13 is mounted to the process unit 9 can be reduced further.

As a result, the developer roller 17 can be pressed against the photosensitive drum 14 more uniformly.

(3) Further, according to the developer cartridge 13 shown in FIG. 7(*b*), the engagement portion 75 is inclined with respect to the right as the engagement portion 75 extends to the lower-rear side.

Thus, the movement amount of the electrode plate 54 in the left-right direction can be increased at the engagement portion 75. That is, the electrode plate 54 can be reduced in rigidity and increased in deformation amount.

As a result, the biasing force of the electrode plate 54 can be reduced further.

(4) Further, according to the developer cartridge 13, as shown in FIGS. 5 and 6, the receiving portion 45 receives (is inserted by) the engagement portion 75 (that is the engagement portion 75 enters the receiving portion 45) when the electrode plate 54 is deformed.

Thus, the movement amount of the engagement portion 75 can be increased further because the engagement portion 75 is received by the receiving section 45. That is, with the configuration in which the engagement portion 75 is received by the receiving section 45, the electrode plate 54 can be reduced in rigidity and increased in deformation amount. As a result, the biasing force of the electrode plate 54 can be reduced further.

(5) Further, according to the developer cartridge 13, as shown in FIG. 10, the input portion 59 is moved in the left-right direction within a range between the right end portion of the boss 64 and the right end portion of the frame 51 (the right side surface 61) when the electrode plate 54 is bended.

Therefore, the pressing force applied to the boss 64 can reliably be transmitted to the contacting region between the contact portion 74 and the process-side electrode 46.

As a result, the friction force occurring between the contact region between the contact portion 74 and the process-side electrode 46 can be canceled by the pressing force applied to the boss 64.

As a result, the developer cartridge 13 can reliably be pressed by pressing the boss 64.

(6) Further, according to the developer cartridge 13, as shown in FIG. 7(*a*), the first extending portions 57 extend from the both end portions of the base portion 56 in the width direction of the electrode plate 54, and the input portion 59 extends from the width direction center of the second extending portion 58.

Thus, when the input portion 59 contacts the process-side electrode 46, the input portion 59 can be supported by the first extending portions 57 at both widthwise ends of the electrode plate 54.

As a result, the input portion 59 can contacts uniformly with the process-side electrode 46 in the width direction.

(7) Further, according to the developer cartridge 13, as shown in FIG. 8(*a*), the electrode cover 55 can cover the base portion 56, the first extending portions 57 and the second extending portion 58 while exposing the input portion 59.

(8) Further, according to the developer cartridge 13, as shown in FIG. 10, the electrode cover 55 has the covering portion 91 which is opposed to the second extending portion 58 with a predetermined interval in the left-right direction.

Thus, when the input portion 59 is moved to the left, the second extending portion 58 can reliably be separated from the frame 51.

(9) Further, according to the process unit 9 and the color laser printer 1, the developer cartridge 13 having the above configuration is provided, so that the developer roller 17 can be pressed against the photosensitive drum 14 uniformly.

What is claimed is:

1. A developer cartridge comprising:

a developing roller including a developing roller shaft extending in a first direction;

a frame extending in the first direction;

an electrode positioned at a side of the frame in the first direction, the electrode having a first state and a second state, the electrode including:

a base portion fixed to the frame at the side of the frame, the base portion including a first end portion and a second end portion separated from the first end portion in a second direction different from the first direction;

a first extending portion extending in the first direction from the first end portion of the base portion; and a second extending portion extending from the first extending portion, the second extending portion opposed to the base portion in the first direction, the second extending portion connected to the first extending portion; and an electrode cover covering at least a portion of the base portion, at least a portion of the first extending portion, and at least a portion of the second extending portion, the electrode cover being made of conductive resin, the electrode cover including:

a bearing having a first hole through which one end portion of the developing roller shaft is inserted; and an electrode supporting portion supporting the electrode;

wherein, in the first state, a distance between the base portion and the second extending portion is a first distance, and wherein, in the second state, the distance between the base portion and the second extending portion is a second distance smaller than the first distance.

2. The developer cartridge according to claim 1, wherein the first extending portion includes a third end portion and a fourth end portion separated from the third end portion in the first direction, wherein the third end portion is connected to the first end portion of the base portion, and wherein the second extending portion extends from the fourth end portion.

3. The developer cartridge according to claim 2, wherein the second extending portion includes a fifth end portion and a sixth end portion separated from the fifth end portion in the second direction, wherein the fifth end portion is connected to the fourth end portion, wherein, in the first state, a distance between the base portion and the sixth end portion of the second extending portion is the first distance, and wherein, in the second state, the distance between the base portion and the sixth end portion of the second extending portion is the second distance smaller than the first distance.

4. The developer cartridge according to claim 1, wherein the electrode cover has a second hole, and wherein the electrode further includes a contact portion extending from the second extending portion, at least a portion of the contact portion being exposed via the second hole.

5. The developer cartridge according to claim 1, wherein the developer cartridge is configured to accommodate developer therein, the developer cartridge further comprising a feed roller configured to feed the developer to the developing roller, the feed roller including a feed roller shaft extending in the first direction, and wherein the bearing has a third hole through which one end portion of the feed roller shaft is inserted.

6. The developer cartridge according to claim 1, wherein the electrode is positioned at an outer surface of the side of the frame in the first direction, and wherein the base portion is fixed to the outer surface.

7. The developer cartridge according to claim 1, wherein the base portion extends in the second direction orthogonal to the first direction.

8. The developer cartridge according to claim 1, wherein the second extending portion extends in the second direction.

9. The developer cartridge according to claim 7, wherein the second extending portion extends in the second direction.

* * * * *